US009290346B2

(12) United States Patent
Horiuchi

(10) Patent No.: US 9,290,346 B2
(45) Date of Patent: Mar. 22, 2016

(54) PAPER SHEET PROCESSING APPARATUS

(71) Applicant: Kabushiki Kaisha Toshiba, Tokyo (JP)

(72) Inventor: Haruhiko Horiuchi, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 154 days.

(21) Appl. No.: 14/152,394

(22) Filed: Jan. 10, 2014

(65) Prior Publication Data

US 2014/0231216 A1 Aug. 21, 2014

(30) Foreign Application Priority Data

Feb. 19, 2013 (JP) ..... 2013-030169

(51) Int. Cl.
*B65H 7/20* (2006.01)
*B65H 7/14* (2006.01)
*B07C 1/00* (2006.01)

(52) U.S. Cl.
CPC .. *B65H 7/20* (2013.01); *B07C 1/00* (2013.01); *B65H 7/14* (2013.01)

(58) Field of Classification Search
CPC ..... B65H 7/14; B65H 7/20; B07C 1/00
See application file for complete search history.

(56) References Cited

U.S. PATENT DOCUMENTS 5,859,440 A * 1/1999 Acquaviva ..... 250/559.36
7,485,637 B2 * 2/2009 Jolidon et al. ..... 514/235.5

FOREIGN PATENT DOCUMENTS

EP 432289 A1 * 6/1991 ..... B65H 7/14
EP 0909591 A2 4/1999
EP 0909591 A3 3/2003
EP 1308407 A2 * 5/2003 ..... B65H 7/14
EP 2409786 A1 1/2012
JP 07294663 A * 11/1995 ..... G01V 8/10
JP 2003341860 A 3/2003
JP 2008280139 A 11/2008

OTHER PUBLICATIONS

Extended European Search Report issued in related European Patent Application No. 14152807.5 mailed May 8, 2014, 5 pages.

* cited by examiner

*Primary Examiner* — Mark A Deuble
(74) *Attorney, Agent, or Firm* — Baker Botts L.L.P.

(57) ABSTRACT

According to an embodiment, a paper sheet processing apparatus is provided with a conveying device which conveys a paper sheet along a conveying way, a discrimination section 14 which distinguishes a paper sheet, a plurality of accumulation sections which accumulate the paper sheet distinguished, a sorting mechanism which sorts the paper sheet distinguished to one of the accumulation sections, a first sensor which includes an opaque substance sensor which detects an opaque substance and a transparent substance sensor which detects a transparent substance, and which detects a paper sheet which is conveyed, a second sensor which detects a paper sheet which is conveyed, and a controller.

7 Claims, 4 Drawing Sheets

PAPER SHEET PROCESSING APPARATUS

CROSS-REFERENCE TO RELATED APPLICATION

This application is based upon and claims the benefit of priority from the prior Japanese Patent Application No. 2013-030169, filed on Feb. 19, 2013, the entire contents of which are incorporated herein by reference.

FIELD

An embodiment of the invention relates to a paper sheet processing apparatus to process a paper sheet, such as a postal matter.

BACKGROUND

Generally, a paper sheet processing apparatus sandwiches and conveys a paper sheet that is a processing object by conveyor belts. In addition, the paper sheet processing apparatus distinguishes and sorts the paper sheet. In the paper sheet processing apparatus, a sensor that detects a position of the paper sheet under conveyance is installed in a conveying way. Usually, a transmission type photoelectric sensor is used as the sensor. The transmission type photoelectric sensor has a light-emitting device and a light-receiving device. The light-emitting device and the light-receiving device are installed so that they may oppose via the conveying way. The transmission type photoelectric sensor detects existence of the paper sheet by detecting that the paper sheet interrupted a light emitted from the light-emitting device.

In recent years, as a processing object, transparent-envelope sealed letters which have a transparent envelope and the contents inserted in the transparent envelope increase in number. The transmission type photoelectric sensor cannot detect the transparent envelope because the light from the transmission type photoelectric sensor penetrates the transparent envelope.

In a case that a processing object under conveyance is sorted, a time when a tip end of the processing object is detected is used as an operation timing of a sorting gate. When the tip end of the processing object is the transparent envelope, operation of the sorting gate cannot start until an opaque portion is conveyed. Therefore, the operation timing of the sorting gate is overdue, and as a result, a trouble that the processing object can not be sorted occurs.

DETAILED EMBODIMENT

According to an embodiment, a paper sheet processing apparatus is provided with a conveying device which conveys a paper sheet along a conveying way, a discrimination section which is provided along the conveying way and distinguishes the paper sheet, a plurality of accumulation sections which accumulate the paper sheet distinguished, a sorting mechanism which sorts the paper sheet distinguished to one of the accumulation sections, a first sensor that includes an opaque substance sensor that detects an opaque substance and a transparent substance sensor that detects a transparent substance, and that detects a paper sheet that is conveyed along the conveying way, a second sensor that is provided between the discrimination section and the sorting mechanism and that detects the paper sheet that is conveyed along the conveying way, a controller which detects a transparent-envelope sealed letter which has a transparent envelope and the contents put in the transparent envelope, based on a detection signal of the transparent substance sensor and a detection signal of the opaque substance sensor.

Hereinafter, an embodiment is described in detail, referring to drawings. A paper sheet processing apparatus 10 of the embodiment that processes a postal matter as a paper sheet is explained below. However, a processing object (namely, a paper sheet) is not restricted to the postal matter.

Figure 1:
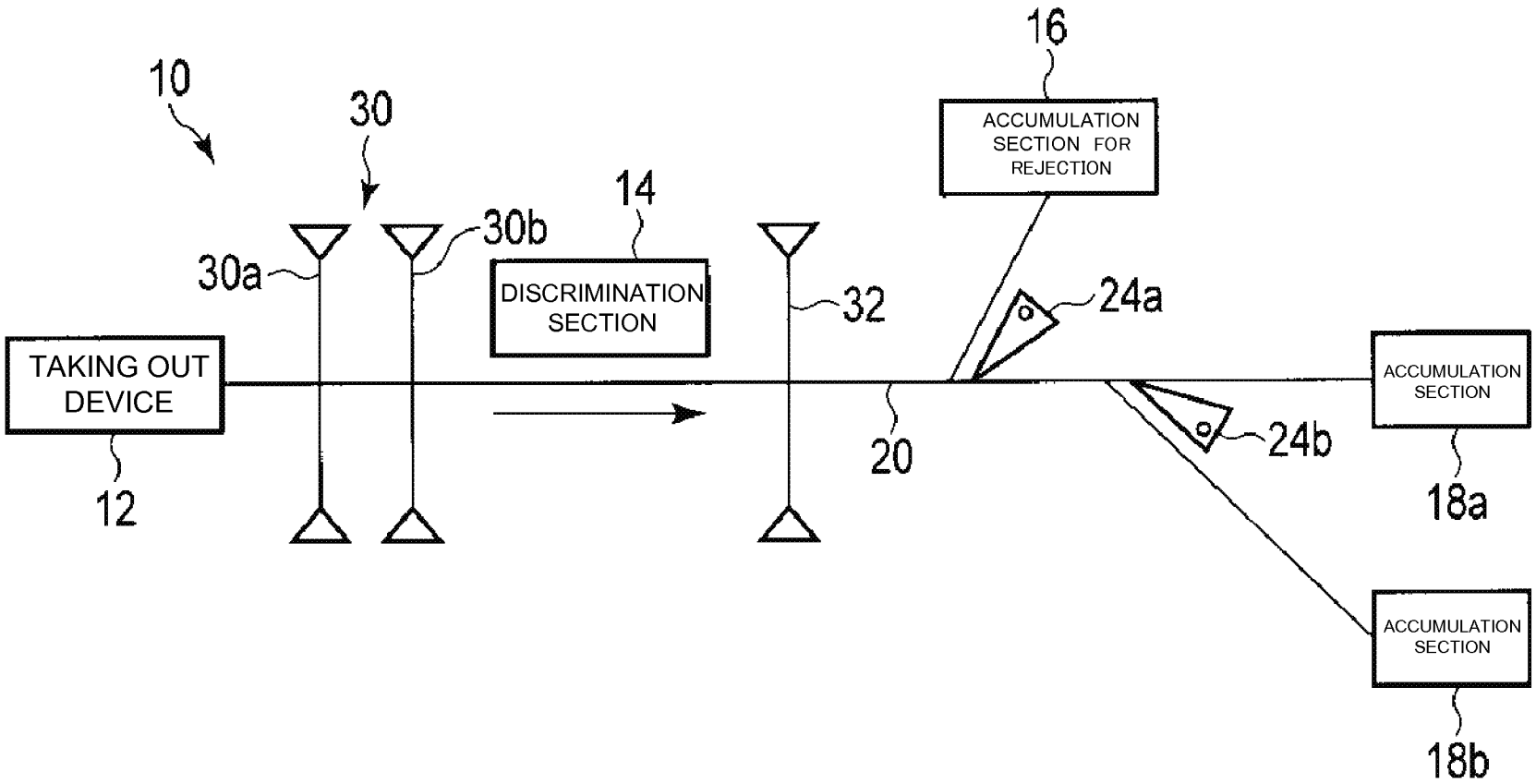
FIG. 1 is a block diagram showing an outline of a paper sheet processing apparatus concerning an embodiment.
Figure 2:
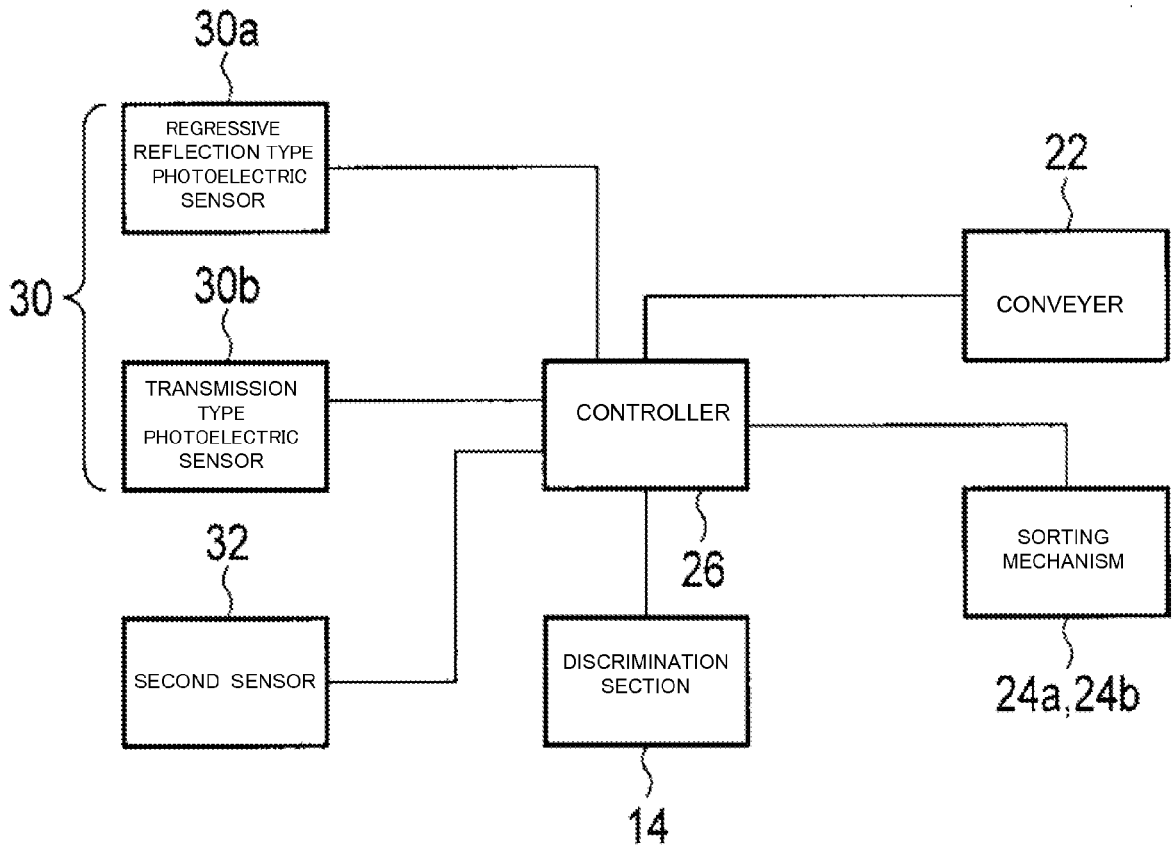
FIG. 2 is a block diagram showing an outline composition of the paper sheet processing apparatus.

FIG. 1 and FIG. 2 show a paper sheet processing apparatus concerning the embodiment roughly. As shown in FIGS. 1 and 2, the paper sheet processing apparatus 10 is provided with an take-out device 12, a discrimination section 14, an accumulation section for rejection 16, a plurality of, for example two, accumulation sections 18*a*, 18*b*, a conveying device 22 that conveys a paper sheet along a conveying way 20, a first and second sorting mechanisms 24*a*, 24*b* that sort the paper sheet, and a controller 26.

In the embodiment, a paper sheet which is a processing object is a postal matter and is specifically a postcard, a sealed letter and a transparent-envelope sealed letter. The transparent-envelope sealed letter has an envelope made of a transparent film and the contents that is put in the envelope. The envelope made of the transparent film may be a transparent film packing of a shape of a rectangular bag that packs the contents.

In the paper sheet processing apparatus, a plurality of postal matters is set in the take-out device 12 in a condition that it is stacked. The take-out device 12 takes out the postal matters one-by-one and puts the taken postal matters on the conveying way 20.

The conveying device 22 is provided with plural sets of endless conveyor belts (not shown) installed so that the conveying way 20 might be formed, and a drive motor (not shown) which drives these conveyor belts. A region that is sandwiched by a set of conveyor belts that oppose serves as the conveying way 20. The postal matter taken out from the take-out device 12 is sandwiched by the conveyor belts and is conveyed along the conveying way 20.

The postal matter taken out on the conveying way 20 is sent to the discrimination section 14, and the discrimination section 14 reads various kinds of information from the postal matter. The discrimination section 14 distinguishes a conveyance posture, a sorted destination, etc. of the postal matter based on the various kinds of read information. For example, the discrimination section 14 reads address information, including a postal code number, an address, etc., that is written to the postal matter, and distinguishes the sorted destination. When the discrimination section 14 cannot read the address information, the discrimination section 14 distinguishes that the postal matter is a postal matter that should be rejected.

The first sorting mechanism 24*a* sorts the postal matter that passed the discrimination section 14. That is, the first sorting mechanism 24*a* sorts the postal matter that should be rejected to the accumulation section 16 for rejection, and the postal matter that should be rejected is accumulated to the accumulation section 16 for rejection. The other postal matters are sent to the second sorting mechanism 24*b*. The second sorting mechanism sorts the postal matter to the desired accumulation sections 18*a*, 18*b*, and the postal matter is accumulated to either of the accumulation sections 18*a* or 18*b*.

As shown in FIGS. 1, 2, the paper sheet processing apparatus 10 is provided with a first sensor 30 installed in an upper stream side of the discrimination section 14, and a second sensor 32 installed between the discrimination section 14 and the first sorting mechanism 24*a*. Each of the first sensor 30 and the second sensor 32 detects a postal matter that is conveyed along the conveying way 20.

The first sensor 30 is constituted by combining a transparent substance sensor that detects a transparent substance and an opaque substance sensor that does not detect the transparent substance but detects only an opaque substance. According to the embodiment, the first sensor 30 is provided with a regressive reflection type photoelectric sensor 30*a* as the transparent substance sensor, and is provided with a transmission type photoelectric sensor 30*b* as the opaque substance sensor. The regressive reflection type photoelectric sensor 30*a* has a reflector plate and a light emitting/light receiving section arranged so that they may oppose via the conveying way 20. The light emitting/light receiving section emits detection light towards the reflector plate and receives the detection light reflected by the reflector plate. The transmission sensor 30*b* has a light emitting section and light receiving section that have been arranged so that they may oppose via the conveying way 20. The light emitting section emits the detection light and the light receiving section receives the detection light (a transmitted light).

The second sensor 32 has a sensor that is capable of detecting the opaque substance, for example, the same transmission type photoelectric sensor as the transmission type photoelectric sensor 30*b*. The transmission type photoelectric sensor has the light emitting section and the light receiving section that are arranged so that they may oppose via the conveying way 20. The light emitting section emits the detection light and the light receiving section receives the detection light (a transmitted light).

The controller 26 detects the existence of the postal matter with a fixed sampling period, for example, 0.5 ms, by the first sensor 30 and the second sensor 32. When the controller 26 detects the postal matter by the first sensor 30, the controller 26 will perform discrimination process to the detected postal matter by the discrimination section 14. The controller 26 determines the accumulation section to which the postal matter is accumulated out of the accumulation sections 18*a*, 18*b* based on a discrimination result. In addition, when the controller 26 detects the postal matter by the second sensor 32, the controller 26 will change the conveying way 20 by the second sorting mechanism 24*b* after a first prescribed time passage, and will convey the postal matter to the accumulation sections 18*a* or 18*b* according to the discrimination result.

Here, the first prescribed time is set up based on a conveyance time necessary to convey a postal matter from the second sensor 32 to the second sorting mechanism 24*b*. The conveyance time is calculated based on a distance between the second sensor 32 and the first sorting mechanism 24*b*, and a conveying speed (running speed of the conveyor belt) of the conveying device 22.

Figure 3:
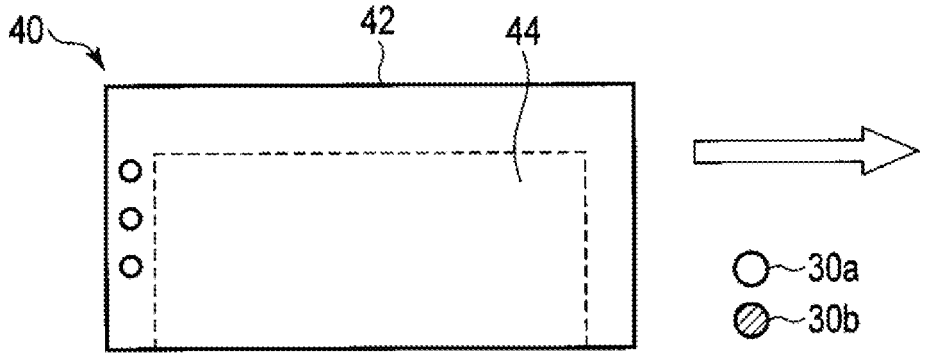
FIG. 3 is a side view showing a transparent-envelope sealed letter.

On the other hand, the postal matter that the paper sheet processing apparatus 10 deals with includes the transparent-envelope sealed letter 40 as shown in FIG. 3. The transparent-envelope sealed letter 40 has a transparent envelope 42 of a rectangle bag-like transparent film, and the contents 44 put in the transparent envelope 42, for example. The contents 44 is opaque substance, such as one sheet or two or more sheets of paper. As for the transparent-envelope sealed letter 40, there is a difference between a conveyance direction length of the transparent envelope 42 and a conveyance direction length of the contents 44.

The transmission type photoelectric sensor 30*b* can detect the opaque substance. That is, the transmission type photoelectric sensor 30*b* can detect the contents 44. However, since the detection light penetrates the transparent envelope 42, the transmission type photoelectric sensor 30*b* cannot detect the transparent envelope 42.

On the other hand, the regressive reflection type photoelectric sensor 30*a* can detect not only the opaque substance but the transparent substance. That is, the regressive reflection type photoelectric sensor 30*a* can detect both an opaque postal matter and the transparent envelope 42.

When the postal matter 40 does not pass through the regressive reflection type photoelectric sensor 30*a*, the light emitting/light receiving section of the regressive reflection type photoelectric sensor 30*a* receives a reflection light from the reflector plate and a detection signal of the regressive reflection type photoelectric sensor 30*a* becomes ON (bright).

When the transparent envelope 42 of the transparent-envelope sealed letter 40 passes through the regressive reflection type photoelectric sensor 30*a*, a reflection light from the reflector plate is weak and cannot permeate the transparent envelope 42. Accordingly, the light emitting/light receiving section of the regressive reflection type photoelectric sensor 30*a* does not receive the reflection light and the detection signal of the regressive reflection type photoelectric sensor 30*a* becomes OFF (dark). Thereby, the regressive reflection type photoelectric sensor 30*a* can detect the transparent envelope 42.

When the opaque postal matter passes through the regressive reflection type photoelectric sensor 30*a*, the detection light cannot penetrate the opaque postal matter, and the light emitting/light receiving section does not receive the reflection light from the reflector plate, and the detection signal of the regressive reflection type photoelectric sensor 30*a* becomes OFF (dark). Thereby, the regressive reflection type photoelectric sensor 30*a* can detect the opaque postal matter.

Accordingly, the regressive reflection type photoelectric sensor 30*a* can detect not only the opaque postal matter but the transparent envelope 42 of the transparent-envelope sealed letter 40.

Figure 4:
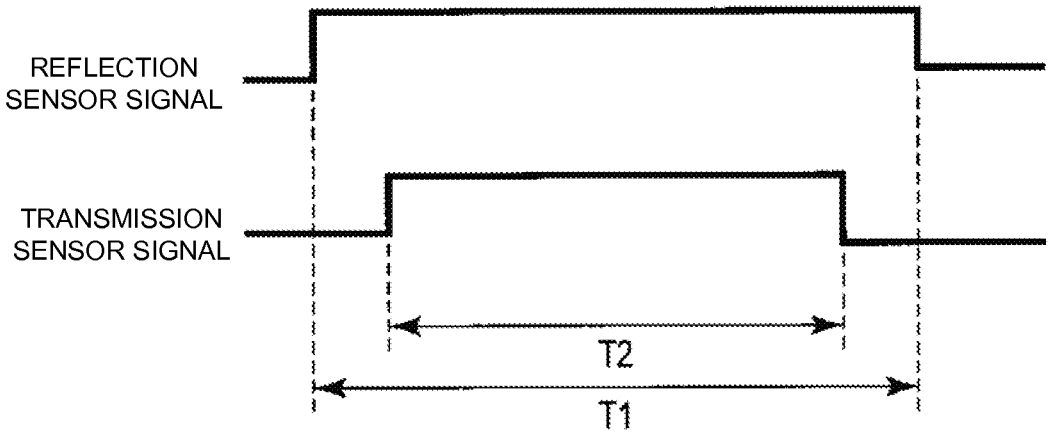
FIG. 4 is a diagram comparing and showing a detection signal of a transmission type photoelectric sensor and a detection signal of a regressive reflection type photoelectric sensor.

In the paper sheet processing apparatus 10 concerning the embodiment, when the transparent-envelope sealed letter 40 is conveyed as shown in FIGS. 3, 4, the regressive reflection type photoelectric sensor 30*a* will detect the transparent envelope 42, and the transmission type photoelectric sensor 30*b* will detect the contents 44.

The controller 26 compares an output signal (a reflection sensor signal) from the regressive reflection type photoelectric sensor 30*a* with an output signal (a transmission sensor signal) from the transmission type photoelectric sensor 30*b*, and compares a substance detection time T1 of the regressive reflection type photoelectric sensor 30*a* with a substance detection time T2 of the transmission type photoelectric sensor 30*b*. When a difference between the substance detection times T1 and T2 is longer than a prescribed time, for example, when the difference is longer than three times of a sampling period, the controller 26 detects that the detected substance is the transparent-envelope sealed letter 40. In addition, what is necessary is to be able to detect the difference between the substance detection times T1 and T2, the regressive reflection type photoelectric sensor 30*a* and the transmission type photoelectric sensor 30*b* do not necessarily need to be installed in the same position to the conveyance direction. In addition, in a case of a usual postcard or a sealed letter, the substance detection times T1 and T2 become almost the same.

When the controller 26 detected the transparent envelope sealed letter 40, the controller 26 operates the second sorting mechanisms 24*a*, 24*b* based on the sorted destination which the discriminator 14 distinguished, and switches the conveying way 20 to a desired accumulation section earlier than a first prescribed time mentioned above from a time when the contents 44 of the transparent-envelope sealed letter 40 is detected by the second sensor 32 by only the difference between the substance detection times T1 and T2.

In a case that the transparent-envelope sealed letter is rejected to the accumulation section for rejection, the controller 26 operates the first sorting mechanism 24*a* and switches the conveying way 20 to the accumulation section for rejection earlier than a second prescribed time from a time when the contents 44 of the transparent-envelope sealed letter 40 is detected by the second sensor 32 by only the difference between the substance detection times T1 and T2.

Here, the second prescribed time is set up based on a conveyance time that is needed to convey the postal matter other than the transparent-envelope sealed letter from the second sensor 32 to the first sorting mechanism 24*a*. The conveyance time is calculated based on a distance between the second sensor 32 and the first sorting mechanism 24*a*, and the conveying speed (running speed of the conveyor belt) of the conveying device 22.

Thereby, also about the transparent-envelope sealed letter 40, the sorting mechanisms 24*a*, 24*b* can be operated at suitable timing, and can send the transparent-envelope sealed letter 40 to the desired accumulation sections 18*a* and 18*b* or the accumulation section 16 for rejection certainly. Simultaneously, generating of a jam of the transparent-envelope sealed letter 40 can be prevented.

In addition, when the substance detection times T1 and T2 are almost the same, the controller 26 detects a pass time (a substance detection time) of the postal matter by the first sensor 30, i.e., the transparent substance sensor, or the opaque substance sensor, and calculates a length of the postal matter from this pass time and the running speed of the conveyor belt. In addition, the controller 26 detects a pass time (a substance detection time) of the postal matter by the second sensor 32, and calculates a length of the postal matter from this pass time and the running speed of the conveyor belt. Then, the controller 26 determines switching timing and switching time of the first or the second sorting mechanisms 24*a* or 24*b* according to the length of the postal matter. Furthermore, when the length of the postal matter detected based on the output signal of the first sensor 30 differs from the length of the postal matter detected based on the output signal of the second sensor 32, the controller 26 judges that there is a detection error, and controls the first sorting mechanism 24*a* so that the first sorting mechanism 24*a* may send the postal matter to the accumulation section 16 for rejection.

Figure 5A:
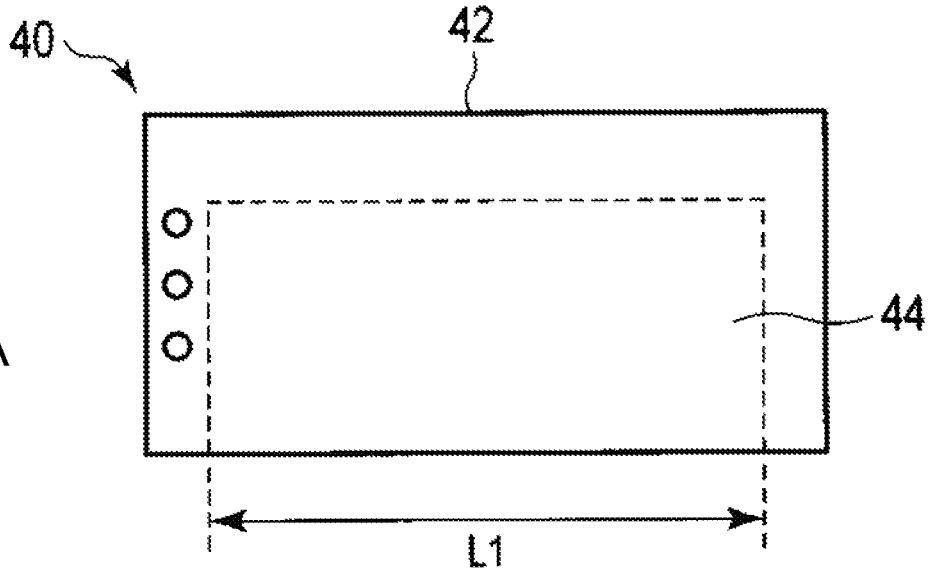
FIGS. 5A and 5B are side views showing a plurality of paper sheets in the transparent envelope.
Figure 5B:
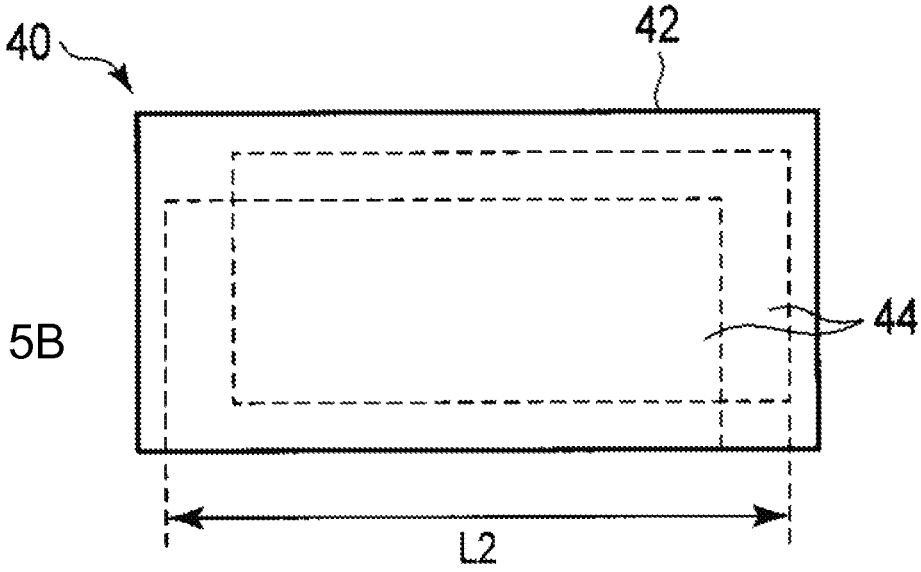

In addition, when the transparent-envelope sealed letter 40 has a plurality of sheets of paper as the contents 44 as shown in FIG. 5A, positions of the sheets of the paper may shift in the transparent envelope 42 during conveyance and a superficial length of the contents 44 may change to L2 from L1 as shown in FIG. 5B. Since the length of the transparent envelope 42 does not change even when the positions of the contents 44 in the transparent envelope 42 have changed and even when the superficial length of the contents 44 has changed, the paper sheet processing apparatus 10 of the embodiment can process the transparent-envelope sealed letter 40 satisfactorily. For this reason, when the controller 26 detects that the postal matter is the transparent-envelope sealed letter 40 (that is, the difference between the substance detection times T1 and T2 is beyond the prescribed time), the controller 26 stops detecting a length of the postal matter based on the detection signal of the second sensor 32. Thereby, an erroneous detection of the length of the postal matter is prevented and generating of an unnecessary error can be prevented.

However, when the length of the postal matter detected based on the detection signal from the transparent substance sensor (the regressive reflection type photoelectric sensor 30*a*) of the first sensor 30 is sharply shorter than a standard size of the postal matter, the controller 26 may judge that the postal matter is folded or the postal matter is cut, and may detect the length of the postal matter by the second sensor 32 and may judge the existence of an error again.

The paper sheet processing apparatus composed as mentioned above can detect a transparent-envelope sealed letter which has a transparent envelope and the contents put in the transparent envelope. When the paper sheet processing apparatus detects the transparent-envelope sealed letter, the paper sheet processing apparatus can prevent jam generating of the postal matter in a portion of the sorting mechanism by adjusting a change timing of the sorting mechanism according to the transparent-envelope sealed letter. Therefore, according to the embodiment, the paper sheet processing apparatus which can process various paper sheets smoothly is obtained. In addition, when the paper sheet processing apparatus detects the transparent-envelope sealed letter, by stopping detecting a length based on the detection signal of the second sensor, the paper sheet processing apparatus prevents an erroneous detection of the length of the postal matter and can prevent generation of errors beforehand.

The invention is not limited to the above-mentioned embodiment as it is, and in a practical stage, the invention is materialized by changing a certain component within the range which does not deviate from the gist of the invention. In addition, various inventions can be formed with proper combination of two or more components currently indicated by the above-mentioned embodiment. For example, some components may be removed from all the components shown in the embodiment.

For example, three or more sensors which detect the existence of the paper sheet and the passage of the paper sheet may be formed not only two. As for the transparent substance sensor and the opaque substance sensor in the first sensor, they are not only a regressive reflection type photoelectric sensor and a transmission type photoelectric sensor, but other sensors, respectively. In addition, a difference between the detection signal times for identifying a transparent packaging medium can be set up arbitrarily, without being based on a sampling period. The above-mentioned embodiment explained a case where a postal matter is used as a paper sheet. However, as for the invention, the paper sheet is not limited to the postal matter.

What is claimed is:

1. A paper sheet processing apparatus, comprising:

a conveying device which conveys a paper sheet along a conveying way;

a discrimination section which is provided along the conveying way and distinguishes the paper sheet;

a plurality of accumulation sections which accumulate the paper sheet distinguished;

a sorting mechanism which sorts the paper sheet distinguished to one of the accumulation sections;

a first sensor which includes an opaque substance sensor to detect an opaque substance and a transparent substance sensor to detect a transparent substance, and which detects the paper sheet which is conveyed along the conveying way;

a second sensor which is provided between the discrimination section and the sorting mechanism, and which detects the paper sheet which is conveyed along the conveying way; and a controller which detects a transparent-envelope sealed letter which has a transparent envelope and the contents inserted in the transparent envelope, based on an output signal of the transparent substance sensor and an output signal of the opaque substance sensor;

wherein the controller is configured to stop detecting the length of the paper sheet based on the detection signal of the second sensor when the transparent-envelope sealed letter is detected.

2. The paper sheet processing apparatus according to claim 1, wherein the controller is configured to detect the transparent-envelope sealed letter based on a difference between a substance detection time by the opaque substance sensor and a substance detection time by the transparent substance sensor.

3. The paper sheet processing apparatus according to claim 2, wherein the controller is configured to switch the sorting mechanism earlier than a prescribed timing by only the difference after the contents is detected by the second sensor in a case where the transparent-envelope sealed letter is detected.

4. The paper sheet processing apparatus according to claim 1, further comprising:

a sorting mechanism for rejection which rejects a paper sheet which is provided in a lower stream side of the second sensor.

5. The paper sheet processing apparatus according to claim 1, wherein the transparent substance sensor is a regressive reflection type photoelectric sensor which detects a reflection light, and the opaque substance sensor is a transmission type photoelectric sensor which detects a transmitted light.

6. The paper sheet processing apparatus according to claim 1, wherein the second sensor is a transmission type photoelectric sensor which detects a transmitted light.

7. The paper sheet processing apparatus according to claim 2, wherein the controller is configured to detect the transparent-envelope sealed letter when the difference is longer than a time set beforehand.

* * * * *